United States Patent [19]

de Decker et al.

[11] Patent Number: 4,670,624

[45] Date of Patent: Jun. 2, 1987

[54] ELECTRICAL SUSPENSION INSULATOR HAVING CORROSION PROTECTIVE DEVICE FOR INSULATOR CAP THEREOF

[75] Inventors: Daniel de Decker; René Parraud; Serge Tartier, all of Saint Yorre, France

[73] Assignee: Ceraver, Paris, France

[21] Appl. No.: 817,651

[22] Filed: Jan. 10, 1986

[51] Int. Cl.[4] ..... H01B 17/42; H01B 17/08

[52] U.S. Cl. ..... 174/140 R; 174/182; 174/211

[58] Field of Search ..... 174/140 R, 140 C, 140 H, 174/140 S, 140 CR, 141 R, 141 C, 144, 182, 211

[56] References Cited

U.S. PATENT DOCUMENTS

| | | | |
|---|---|---|---|
| 1,659,183 | 2/1928 | Austin | 174/140 H |
| 1,730,232 | 10/1929 | Newill | 174/141 R |
| 4,016,358 | 4/1977 | Richards | 174/141 R |

FOREIGN PATENT DOCUMENTS

| | | | |
|---|---|---|---|
| 2332598 | 6/1977 | France | 174/211 |

*Primary Examiner*—Laramie E. Askin

*Attorney, Agent, or Firm*—Sughrue, Mion, Zinn, Macpeak & Seas

[57] ABSTRACT

An electrical insulator (1) of the type comprising at least one dielectric (2) and an iron or steel cap (3) fixed axially on the dielectric has a device for protecting the cap against corrosion as well as electric arcs. In one embodiment (FIGS. 1-3), the protection device comprises a zinc or aluminum part (10) shaped as a dish with a center hole (11) and outlet holes (12) for the egress of rainwater. The outside wall (13) of the part (10) curves upwardly toward the cap (3) and a portion of the part (10) is disposed between the base (6) of the cap (3) and the outer surface (7) of the dielectric (2). In another embodiment (FIG. 4), the protection device comprises a solid body of revolution (30) of semi-toroidal shape which is formed of zinc or aluminum and is cast directly around the base (6) of the cap (3) and has a thin flange extending between the base (6)of the cap (3) and the outer surface (7) of the dielectric (2). The exterior surface (31) of the solid body of revolution (30) curves upwardly so as to provide between such exterior surface and the outer surface (7) of the dielectric (2) an area for the self-extinguishing of electric arcs.

2 Claims, 4 Drawing Figures

ELECTRICAL SUSPENSION INSULATOR HAVING CORROSION PROTECTIVE DEVICE FOR INSULATOR CAP THEREOF

FIELD OF THE INVENTION

This invention concerns a device to protect the cap of a suspension-type electrical insulator against corrosion.

BACKGROUND OF THE INVENTION

The insulators concerned have a glass dielectric, are of the cap-and-pin type and form suspension strings intended in particular for medium, high and very high voltage power transmission lines (for example 150 kV and 250 kV lines).

When a leakage current flows through a string of insulators, the latter are subjected to arcing activity. These arcs generally begin, i.e. are initiated, at the metallic parts, in the transition zone between a conductor and an insulator, in other words, at the base of the insulator cap.

Heretofore, the caps have been protected against corrosion by galvanizing their outside suface. But the arcs flashing from the metal parts tend to erode this protective coating. The caps then become directly exposed to agents of atmospheric corrosion, which eventually degrade the mechanical properties of the metal parts and so contaminate the surface of the insulator by the iron oxide produced by corrosion.

It is the object of the present invention to obviate this disadvantage without modifying any of the following insulator characteristics:

- their commercial power frequency operation in both dry and wet conditions;
- their lightning withstand capability,
- and their radio interference level.

SUMMARY OF THE INVENTION

The invention provides a corrosion protection device for a suspension insulator cap, said cap being sealed onto the head of a glass dielectric, said protection device consisting of a circular part formed as a body of revolution about the axis of the insulator, having on the one hand a center opening the edge whereof is clamped between the wall of the said dielectric and the base of the said cap, and having on the other hand an outside wall curving upwardly toward the said cap such as to set up a region between the said outside wall and the wall of said dielectric for the self-extinguishing of electric arcs.

The material of the cap may be, for example, either cast iron or steel, and the material of said protective body of revolution may be either zinc or aluminum or their alloys, for example.

According to one embodiment, the said body of revolution is shaped as a hat rim, or centerless dish, preferably provided with suitable openings for the egress of rainwater.

According to another embodiment, said body of revolution part is shaped as a solid half-torus and is molded directly to said cap at the level of its base.

It is observed that such a protective device enables protection of the base of the caps against arc roots and thus avoids their corroding, without altering the characteristics required for their wet and dry electrical performance, lightning performance and radio interference level.

In the case of direct current power lines, the protective device according to the invention affords the additional great advantage of protecting the insulator cap against electrolytic corrosion by being corroded before the cap.

Other features and advantages of the invention will appear in the course of the following description of preferred, nonlimiting embodiments, made with reference to the accompanying drawings.

DESCRIPTION OF THE PREFERRED EMBODIMENTS

Figure 1:
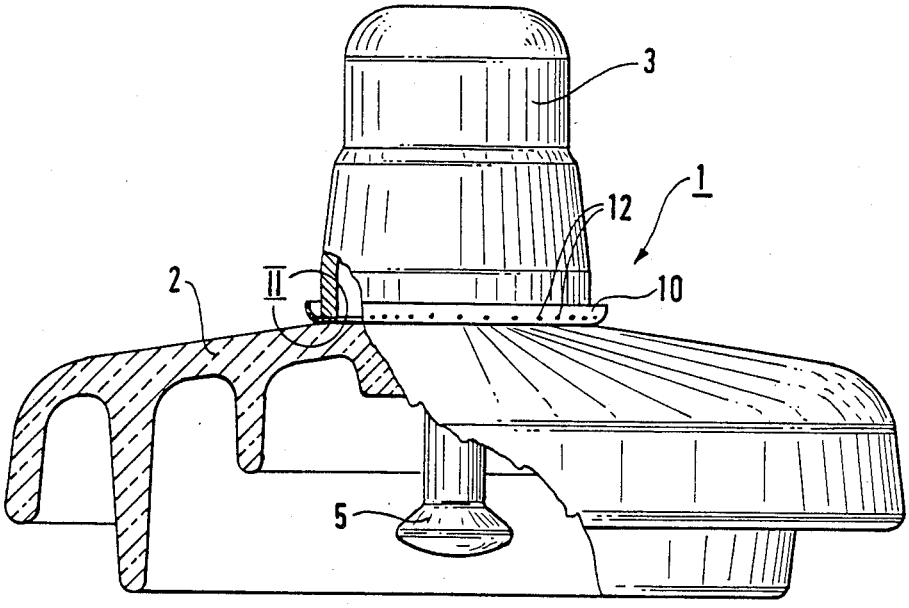
FIG. 1 is a partly cut-away view in elevation of a cap-and-pin insulator equipped with a corrosion protection device according to the invention.

FIG. 1 illustrates an insulator 1 forming part of a suspension string and comprising a glass dielectric 2, the skirt whereof is apparent, and the head whereof is sealed into a metal cap 3 galvanically coated with zinc.

In addition, a metal pin 5 is attached inside the head of the dielectric 2.

Figure 2:
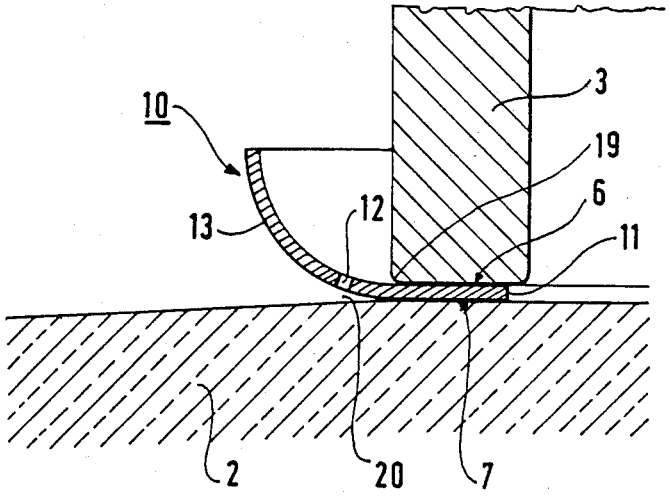
FIG. 2 is an enlarged, partial cross-section of a detail (II) of FIG. 1.

In accordance with the invention, and as best illustrated in FIG. 2, a zinc or aluminum part 10 shaped as a dish with a center hole 11 is interposed between the base 6 of the cap 3 and the outside surface 7 of the dielectric 2 skirt; this center hole 11 in the dish enables the dish to be slipped over the head of the dielectric 2 prior to installation of the cap 3. The dish is provided with outlet holess 12 for the egress of rainwater. Its outside wall 13 curves up toward the cap 3.

Figure 3:
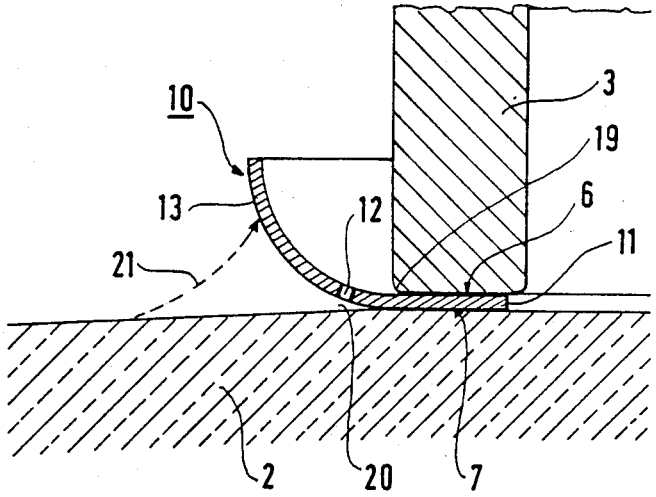
FIG. 3 is a duplicate of FIG. 2 showing the arcing path in such a structure.

FIG. 3 shows the evolution of electric arcs in the structure according to the invention. Instead of being initiated between the region 19 around the base 6 of the cap 3 and the facing part of the surface 7 of the dielectric 2, the arcs appear in the region 20 located between the wall 13 of the inventive part 10 and the surface 7 of the dielectric 2. The arcs then strike across the region 21 identified in FIG. 3 and extinguish, never damaging the base 6 of the cap 3.

It has been ascertained besides that the part 10 in no way disturbs the distribution of the electric field around the insulator.

When the insulator of FIG. 1 is used in direct current lines, the structure according to the invention provides additional advantages. Thus, when the cap 3 has a positive polarity with respect to the dielectric 2, it is a fact that in the absense of a part 10 a leakage current occurs which creates a considerable electrolytic corrosion at the level of the base 6 of the cap 3. When the part 10 is installed, however, it is this part which is subjected to corrosion and thus protects the cap.

Figure 4:
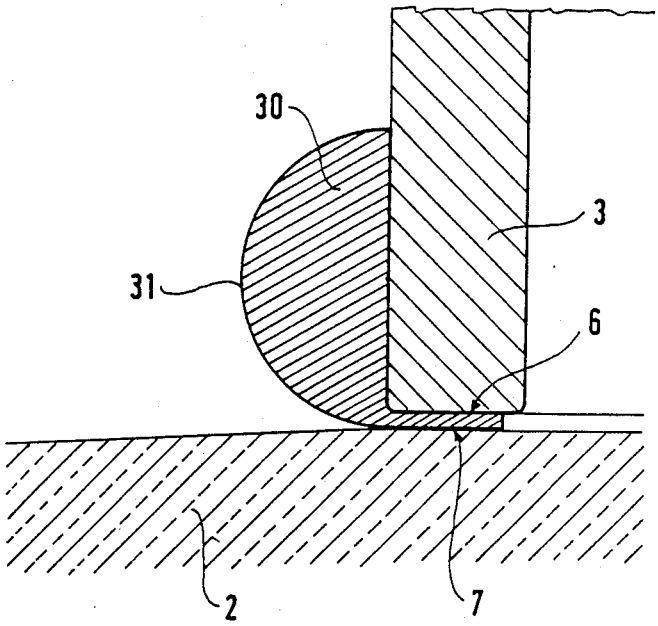
FIG. 4 is a partial cross-section of a detail of an alternate protective device according to the invention.

FIG. 4 shows an alternative embodiment of the part 10, which in this case is made as a body 30 of revolution about the axis of the insulator head and has substantially the shape of a half-torus extended by a flange. The part may be made of zinc or of aluminum and can be cast directly to the insulator equipped with its sealed cap. This part 30 fulfills the same functions as part 10. In particular, its outside surface 31, which curves up to meet the cap 3, contributes to extinguishing electric arcs.

The description of two embodiments herein should not be construed as limiting the scope of the invention and it is desired that other embodiments and variants thereof be considered within the scope and spirit of the invention as defined by the appended claims.

We claim:

1. An electrical suspension insulator comprising at least one dielectric, a metallic cap fixed axially on the dielectric, and a device for protecting the cap against corrosion comprising a solid body of revolution of semi-toroidal shape positioned around the base of the cap, an integral planar flange projecting radially inwardly of the semi-toroidal shape solid body of revolution and being wedged between the surface of the dielectric and the base of said cap, said device having an exterior surface curved towards said cap so as to provide between the exterior surface and the surface of the dielectric an area for the self-extinguishing of electric arcs, said cap being formed of one material selected from the group consisting of iron and steel, said solid body of revolution being formed of one material selected form the group consisting of zinc, aluminum and their alloys.

2. An electrical isnulator in accordance with claim 1, wherein said solid body of revolution is a solid body cast directly about said cap at the base of said cap.

* * * * *

UNITED STATES PATENT AND TRADEMARK OFFICE

CERTIFICATE OF CORRECTION

PATENT NO. : 4,670,624

DATED : June 2, 1987

INVENTOR(S) : Daniel DeDecker

It is certified that error appears in the above-identified patent and that said Letters Patent is hereby corrected as shown below:

On the title page, after item [22] insert:

-- [30] Foreign Application Priority Data
November 15, 1985 [Fr] France..... 85 16 919 --.

Signed and Sealed this

Ninth Day of May, 1989

*Attest:*

DONALD J. QUIGG

*Attesting Officer*

*Commissioner of Patents and Trademarks*